US012044452B2

(12) United States Patent
Kumakura et al.

(10) Patent No.: US 12,044,452 B2
(45) Date of Patent: Jul. 23, 2024

(54) HEAT PUMP DEVICE USING A NON-AZEOTROPIC MIXTURE REFRIGERANT

(71) Applicant: DAIKIN INDUSTRIES, LTD., Osaka (JP)

(72) Inventors: Eiji Kumakura, Osaka (JP); Ryuhei Kaji, Osaka (JP); Atsushi Yoshimi, Osaka (JP); Masaki Tanaka, Osaka (JP); Hiroki Ueda, Osaka (JP); Masaki Nakayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/374,453

(22) Filed: Sep. 28, 2023

(65) Prior Publication Data

US 2024/0027115 A1 Jan. 25, 2024

Related U.S. Application Data

(63) Continuation of application No. PCT/JP2022/015957, filed on Mar. 30, 2022.

(30) Foreign Application Priority Data

Mar. 31, 2021 (JP) ..... 2021-061281

(51) Int. Cl.
*F25B 49/02* (2006.01)
*F25B 9/00* (2006.01)
*F25B 41/20* (2021.01)

(52) U.S. Cl.
CPC ..... *F25B 49/02* (2013.01); *F25B 9/002* (2013.01); *F25B 41/20* (2021.01); *F25B 2700/19* (2013.01); *F25B 2700/21* (2013.01)

(58) Field of Classification Search
CPC ..... F25B 49/02; F25B 9/002; F25B 41/20; F25B 2700/19; F25B 2700/21
See application file for complete search history.

(56) References Cited

U.S. PATENT DOCUMENTS 5,410,887 A 5/1995 Urata et al.
5,737,931 A * 4/1998 Ueno ..... F25B 9/006 62/502

(Continued)

FOREIGN PATENT DOCUMENTS

CN 101839579 A 9/2010
CN 102066852 A 5/2011

(Continued)

OTHER PUBLICATIONS

International Search Report for PCT/JP2022/015957 mailed on May 31, 2022.

(Continued)

*Primary Examiner* — Henry T Crenshaw
(74) *Attorney, Agent, or Firm* — Birch, Stewart, Kolasch & Birch, LLP

(57) ABSTRACT

In an air conditioner, during an operation, a gas-liquid two-phase non-azeotropic mixture refrigerant enters a receiver and accumulates in the receiver in a state where a gas phase and a liquid phase are separated. For example, when the non-azeotropic mixture refrigerant includes two components, i.e., a high-boiling refrigerant and a low-boiling refrigerant, the controller may estimate the ratio (composition ratio) between the low-boiling refrigerant and the high-boiling refrigerant in each of the gas phase and the liquid phase based on the temperature and the pressure of the non-azeotropic mixture refrigerant in the receiver. Thus, the controller may estimate the composition ratio of the liquid-phase non-azeotropic mixture refrigerant flowing out of the (Continued)

receiver as the composition ratio of the non-azeotropic mixture refrigerant circulating in the refrigerant circuit.

20 Claims, 6 Drawing Sheets

(56) References Cited

U.S. PATENT DOCUMENTS

| | | | | |
|---|---|---|---|---|
| 5,996,358 | A | 12/1999 | Sumida et al. | |
| 2010/0101245 | A1* | 4/2010 | Bivens | F25B 41/335 62/77 |
| 2011/0079042 | A1 | 4/2011 | Yamashita et al. | |
| 2014/0124699 | A1* | 5/2014 | Low | C11D 7/5027 516/8 |
| 2014/0150483 | A1* | 6/2014 | Takayama | F25B 30/02 62/160 |
| 2014/0331702 | A1* | 11/2014 | Tanaka | F25B 49/02 62/159 |
| 2015/0059380 | A1* | 3/2015 | Takayama | F25B 49/022 62/222 |
| 2018/0058740 | A1* | 3/2018 | Nishiyama | F25B 49/02 |
| 2018/0363965 | A1 | 12/2018 | Hayamizu et al. | |

FOREIGN PATENT DOCUMENTS

| | | | |
|---|---|---|---|
| EP | 2 746 699 | A1 | 6/2014 |
| EP | 3 816 537 | A1 | 5/2021 |
| GB | 2585418 | A | 1/2021 |
| JP | 1-256765 | A | 10/1989 |
| JP | 5-24417 | B2 | 4/1993 |
| JP | 6-117737 | A | 4/1994 |
| JP | 11-63747 | A | 3/1999 |
| JP | 11-316060 | A | 11/1999 |
| JP | 3463710 | B2 | 11/2003 |
| JP | 2010-514851 | A | 5/2010 |
| WO | WO 2013/027232 | A1 | 2/2013 |
| WO | WO 2015/140871 | A1 | 9/2015 |
| WO | WO 2017/145826 | A1 | 8/2017 |
| WO | WO2019/023267 | A1 | 1/2019 |
| WO | WO 2019/053880 | A1 | 3/2019 |
| WO | WO 2020/003494 | A1 | 1/2020 |

OTHER PUBLICATIONS

International Preliminary Report on Patentability and English translation of the Written Opinion of the International Searching Authority for International Application No. PCT/JP2022/015957, dated Oct. 3, 2023.

Extended European Search Report for European Application No. 22781082.7, dated Mar. 19, 2024.

* cited by examiner

HEAT PUMP DEVICE USING A NON-AZEOTROPIC MIXTURE REFRIGERANT

CROSS REFERENCE TO RELATED APPLICATIONS

This application is a Continuation of PCT International Application No. PCT/JP2022/015957, filed on Mar. 30, 2022, which claims priority under 35 U.S.C. § 119(a) to Patent Application No. JP 2021-061281, filed in Japan on Mar. 31, 2021, all of which are hereby expressly incorporated by reference into the present application.

TECHNICAL FIELD

The present invention relates to a heat pump device.

BACKGROUND ART

In a heat pump device such as an air conditioner using a non-azeotropic mixture refrigerant, the composition ratio of the non-azeotropic mixture refrigerant circulating during the operation may change, flammability may increase, or a disproportionation reaction may occur. Therefore, in a refrigeration apparatus described in PTL 1 (Japanese Patent No. 3463710), a two-phase refrigerant is accumulated in an accumulator in order to detect the composition ratio of the circulating refrigerant, and the composition ratio of the circulating refrigerant is estimated based on detection values of temperature and pressure of the refrigerant.

SUMMARY

A heat pump device according to a first aspect is a heat pump device having a non-azeotropic mixture refrigerant circulating in a refrigerant circuit in which a compressor, a four-way switching valve, a condenser, a first expansion mechanism, a second expansion mechanism, and an evaporator are sequentially coupled with pipes in a circular pattern. The heat pump device includes a container, a temperature measurement unit, a pressure measurement unit, and a control unit. The container is coupled between the first expansion mechanism and the second expansion mechanism. The temperature measurement unit measures a temperature of the non-azeotropic mixture refrigerant in the container. The pressure measurement unit measures a pressure of the non-azeotropic mixture refrigerant in the container. Here, the pressure of the non-azeotropic mixture refrigerant in the container may be replaced with the pressure in a pipe coupled to the container. The control unit estimates a physical property of the circulating non-azeotropic mixture refrigerant based on the temperature and the pressure of the non-azeotropic mixture refrigerant accumulated in the container.

DESCRIPTION OF EMBODIMENTS (1) Overview

Figure 1:
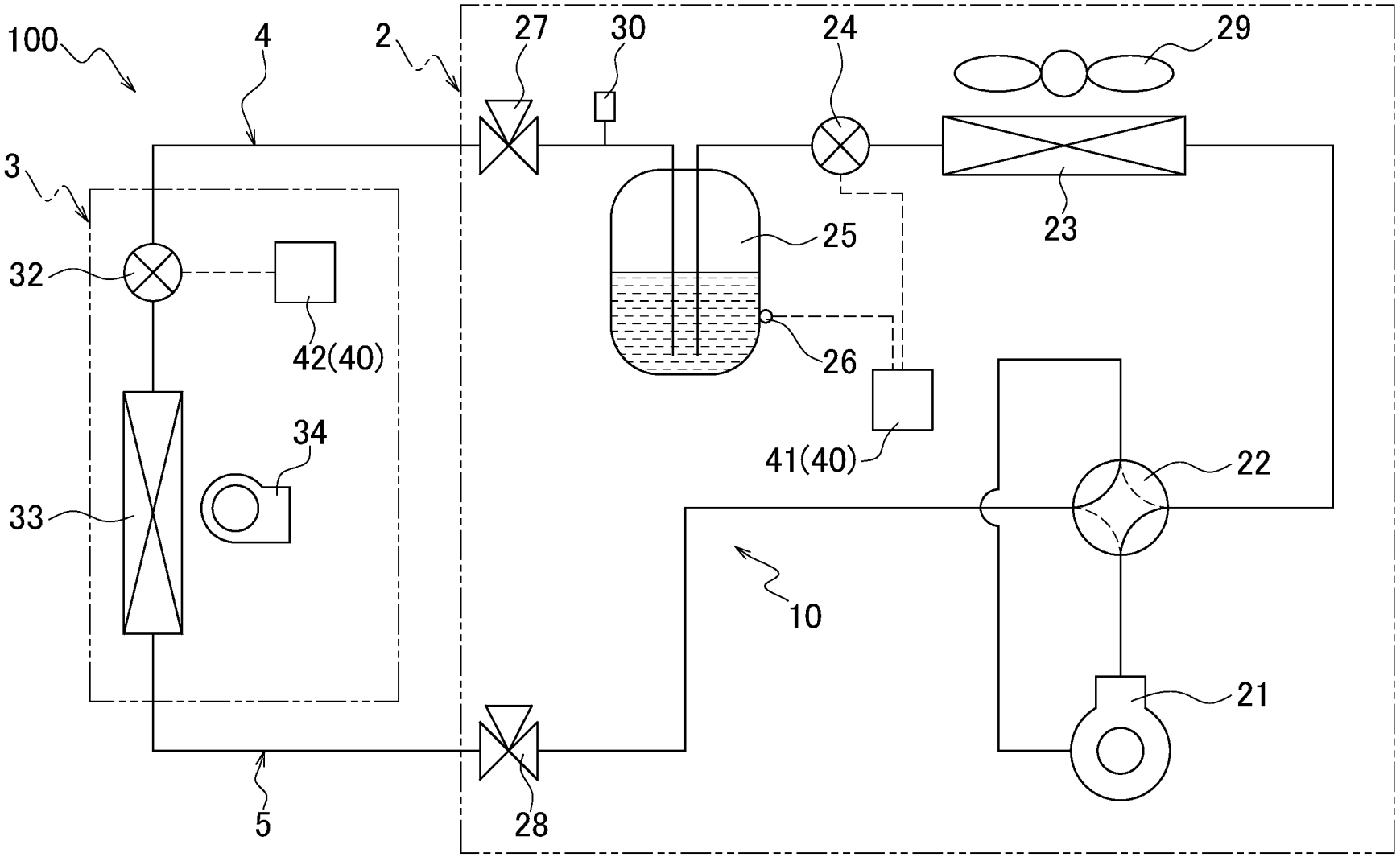
FIG. 1 is a configuration diagram illustrating an embodiment of an air conditioner that is a heat pump device according to the present disclosure.

FIG. 1 is a configuration diagram illustrating an embodiment of an air conditioner 100 that is a heat pump device according to the present disclosure. In FIG. 1, the air conditioner 100 includes a refrigerant circuit 10.

The refrigerant circuit 10 is a circuit in which a compressor 21, a four-way switching valve 22, an outdoor heat exchanger 23, a first flow-rate adjustment valve 24, a receiver 25, a second flow-rate adjustment valve 32, and an indoor heat exchanger 33 are coupled with pipes in a circular pattern in this order.

As illustrated in FIG. 1, the receiver 25 is provided between the first flow-rate adjustment valve 24 and the second flow-rate adjustment valve 32. In the refrigerant circuit 10, a non-azeotropic mixture refrigerant circulates, which is two or more types of refrigerants having different boiling points, and includes CO2 and R1234yf as components.

The components of the non-azeotropic mixture refrigerant are not limited to CO2 and R1234yf and may include, for example, CO2 and R1234ze as components. Furthermore, instead of the above-described CO2, R1132(E) or R1123 may be included.

(2) Detailed Configuration of Air Conditioner 100

The air conditioner 100 includes an outdoor unit 2, an indoor unit 3, a liquid-refrigerant connection pipe 4 and a gas-refrigerant connection pipe 5 that connect the outdoor unit 2 and the indoor unit 3, and a control unit 40 that controls component devices of the outdoor unit 2 and the indoor unit 3.

(2-1) Outdoor Unit 2

The outdoor unit 2 is installed outdoors and forms a part of the refrigerant circuit 10. The outdoor unit 2 includes the compressor 21, the four-way switching valve 22, the outdoor heat exchanger 23, the first flow-rate adjustment valve 24, the receiver 25, a liquid-side shutoff valve 27, a gas-side shutoff valve 28, and an outdoor fan 29.

(2-1-1) Compressor 21

The compressor 21 compresses the refrigerant. An intake side and a discharge side of the compressor 21 are coupled to the four-way switching valve 22.

(2-1-2) Four-Way Switching Valve 22

When the four-way switching valve 22 causes the outdoor heat exchanger 23 to function as a condenser of the refrigerant, the discharge side of the compressor 21 is coupled to a gas side of the outdoor heat exchanger 23 (see the solid lines of the four-way switching valve 22 in FIG. 1).

Furthermore, when the four-way switching valve 22 causes the outdoor heat exchanger 23 to function as an evaporator of the refrigerant, the intake side of the compressor 21 is coupled to the gas side of the outdoor heat exchanger 23 (see the broken lines of the four-way switching valve 22 in FIG. 1).

(2-1-3) Outdoor Heat Exchanger 23

The outdoor heat exchanger 23 exchanges heat between the refrigerant and the outdoor air. One end side of the outdoor heat exchanger 23 is coupled to the first flow-rate adjustment valve 24, and the other end side of the outdoor heat exchanger 23 is coupled to the four-way switching valve 22.

(2-1-4) First Flow-Rate Adjustment Valve 24

The first flow-rate adjustment valve 24 is an expansion mechanism that reduces the pressure of the refrigerant and uses an electric expansion valve here. One end side of the first flow-rate adjustment valve 24 is coupled to the outdoor heat exchanger 23, and the other end side of the first flow-rate adjustment valve 24 is coupled to the receiver 25.

(2-1-5) Receiver 25

The receiver 25 is a container to temporarily store the refrigerant. One end side of the receiver 25 is coupled to the first flow-rate adjustment valve 24, and the other end side of the receiver 25 is coupled to the liquid-side shutoff valve 27.

A temperature sensor 26 is attached to a lower side surface of the receiver 25. The temperature sensor 26 measures the temperature of the liquid-phase non-azeotrope mixture refrigerant accumulated in the receiver 25.

(2-1-6) Liquid-Side Shutoff Valve 27 and Gas-Side Shutoff Valve 28

The liquid-side shutoff valve 27 is a valve mechanism provided in a coupling portion between the outdoor unit 2 and the liquid-refrigerant connection pipe 4. One end side of the liquid-side shutoff valve 27 is coupled to the receiver 25, and the other end side of the liquid-side shutoff valve 27 is coupled to the liquid-refrigerant connection pipe 4.

The gas-side shutoff valve 28 is a valve mechanism provided in a coupling portion between the outdoor unit 2 and the gas-refrigerant connection pipe 5. One end side of the gas-side shutoff valve 28 is coupled to the four-way switching valve 22, and the other end side of the gas-side shutoff valve 28 is coupled to the gas-refrigerant connection pipe 5.

(2-1-7) Outdoor Fan 29

The outdoor fan 29 is a fan that supplies outdoor air to the outdoor heat exchanger 23.

(2-1-8) Pressure Sensor 30

A pressure sensor 30 is installed in a pipe coupling the receiver 25 and the liquid-side shutoff valve 27 to measure the pressure of the non-azeotropic mixture refrigerant flowing in the pipe. The measurement value is substituted as the pressure of the liquid-phase non-azeotropic mixture refrigerant in the receiver 25.

The installation place of the pressure sensor 30 is not limited to the pipe, and the pressure sensor 30 may be installed in the receiver 25 to directly measure the pressure of the non-azeotropic mixture refrigerant in the receiver 25.

(2-2) Indoor Unit 3

The indoor unit 3 is installed indoors or in the ceiling to form a part of the refrigerant circuit 10. The indoor unit 3 includes the second flow-rate adjustment valve 32, the indoor heat exchanger 33, and an indoor fan 34.

(2-2-1) Second Flow-Rate Adjustment Valve 32

The second flow-rate adjustment valve 32 is an expansion mechanism that reduces the pressure of the refrigerant and here uses an electric expansion valve.

The second flow-rate adjustment valve 32 does not necessarily need to be installed in the indoor unit 3 and may be installed between the receiver 25 and the liquid-side shutoff valve 27 in the outdoor unit 2.

(2-2-2) Indoor Heat Exchanger 33

The indoor heat exchanger 33 is a heat exchanger that exchanges heat between the refrigerant and the indoor air. One end side of the indoor heat exchanger 33 is coupled to the second flow-rate adjustment valve 32, and the other end side of the indoor heat exchanger 33 is coupled to the gas-refrigerant connection pipe 5.

(2-2-3) Indoor Fan 34

The indoor fan 34 is a fan that supplies indoor air to the indoor heat exchanger 33.

(2-3) Control Unit 40

The control unit 40 is configured by the communication connection between an outdoor-side control unit 41 of the outdoor unit 2 and an indoor-side control unit 42 of the indoor unit 3. The control unit 40 performs the operation control of the entire air conditioner 100, including the operation of the refrigerant circuit 10.

Furthermore, the control unit 40 estimates the composition ratio of the non-azeotropic mixture refrigerant accumulated in the receiver 25 by using a gas-liquid equilibrium graph generated based on the temperature measurement value of the temperature sensor 26 and the pressure measurement value of the pressure sensor 30 or a previously stored gas-liquid equilibrium graph (for example, see FIG. 2) with respect to the temperature and the pressure.

(3) Air Conditioning Operation

In the air conditioner 100, the control unit 40 performs a cooling operation and a heating operation.

(3-1) Cooling Operation

During the cooling operation, the four-way switching valve 22 is switched to the state indicated in the solid lines in FIG. 1. In the refrigerant circuit 10, the low-pressure gas-phase non-azeotropic mixture refrigerant is suctioned into the compressor 21, compressed to have a high pressure, and then discharged. The high-pressure gas-phase non-azeotropic mixture refrigerant discharged from the compressor 21 is sent to the outdoor heat exchanger 23 through the four-way switching valve 22.

The high-pressure gas-phase non-azeotropic mixture refrigerant sent to the outdoor heat exchanger 23 exchanges heat with the outdoor air supplied from the outdoor fan 29 in the outdoor heat exchanger 23, which functions as a condenser for the non-azeotropic mixture refrigerant, and is condensed into a high-pressure liquid-phase non-azeotropic mixture refrigerant.

The high-pressure liquid-phase non-azeotropic mixture refrigerant condensed in the outdoor heat exchanger 23 is decompressed to an intermediate pressure by the first flow-rate adjustment valve 24, becomes a gas-liquid two-phase non-azeotropic mixture refrigerant, and enters the receiver 25. The gas-liquid two-phase non-azeotropic mixture refrigerant having entered the receiver 25 is temporarily accumulated and separated into a liquid-phase non-azeotropic mixture refrigerant and a gas-phase non-azeotropic mixture refrigerant.

The liquid-phase non-azeotropic mixture refrigerant accumulated in the receiver 25 is sent to the second flow-rate adjustment valve 32. The non-azeotropic mixture refrigerant is decompressed to a low pressure by the second flow-rate adjustment valve 32 and becomes a low-pressure gas-liquid two-phase non-azeotropic mixture refrigerant.

The low-pressure gas-liquid two-phase non-azeotropic mixture refrigerant is sent to the indoor heat exchanger 33. The non-azeotropic mixture refrigerant sent to the indoor heat exchanger 33 exchanges heat with the indoor air supplied from the indoor fan 34 and evaporates in the indoor heat exchanger 33.

Accordingly, the indoor air is cooled and supplied to the room so that the room is cooled. The low-pressure gas-phase non-azeotropic mixture refrigerant evaporated in the indoor heat exchanger 33 is suctioned into the compressor 21 again through the four-way switching valve 22.

(3-2) Heating Operation

During the heating operation, the four-way switching valve 22 is switched to the state indicated in the broken lines in FIG. 1. In the refrigerant circuit 10, the low-pressure gas-phase non-azeotropic mixture refrigerant is suctioned into the compressor 21, compressed to have a high pressure, and then discharged.

The high-pressure gas-phase non-azeotropic mixture refrigerant discharged from the compressor 21 is sent to the indoor heat exchanger 33 through the four-way switching valve 22. The high-pressure gas-phase non-azeotropic mixture refrigerant sent to the indoor heat exchanger 33 exchanges heat with the indoor air supplied from the indoor fan 34 and is condensed into a high-pressure liquid-phase non-azeotropic mixture refrigerant in the indoor heat exchanger 33.

Accordingly, the indoor air is heated and then supplied to the room so that the room is heated. The high-pressure liquid-phase non-azeotropic mixture refrigerant condensed in the indoor heat exchanger 33 is decompressed to an intermediate pressure by the second flow-rate adjustment valve 32, becomes a gas-liquid two-phase non-azeotropic mixture refrigerant, and enters the receiver 25.

The gas-liquid two-phase non-azeotropic mixture refrigerant having entered the receiver 25 is temporarily accumulated and separated into a liquid-phase non-azeotropic mixture refrigerant and a gas-phase non-azeotropic mixture refrigerant.

The liquid-phase non-azeotropic mixture refrigerant accumulated in the receiver 25 is sent to the first flow-rate adjustment valve 24. The non-azeotropic mixture refrigerant is decompressed to a low pressure by the first flow-rate adjustment valve 24 and becomes a low-pressure gas-liquid two-phase non-azeotropic mixture refrigerant.

The low-pressure gas-liquid two-phase non-azeotropic mixture refrigerant is sent to the outdoor heat exchanger 23. The low-pressure gas-liquid two-phase non-azeotropic mixture refrigerant sent to the outdoor heat exchanger 23 exchanges heat with the outdoor air supplied from the outdoor fan 29 and evaporates in the outdoor heat exchanger 23 to become a low-pressure gas-phase non-azeotropic mixture refrigerant. The low-pressure gas-phase non-azeotropic mixture refrigerant is suctioned into the compressor 21 again through the four-way switching valve 22.

(4) Estimating Composition Ratio of Non-azeotropic Mixture Refrigerant Circulating in Refrigerant Circuit 10

Figure 2:
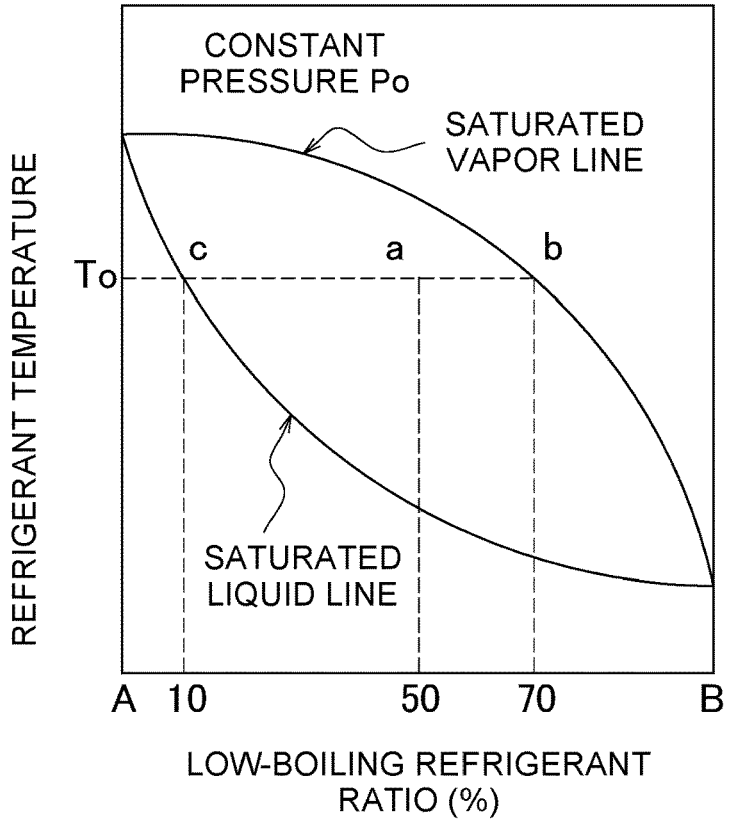
FIG. 2 is a gas-liquid equilibrium diagram illustrating a state of a non-azeotropic mixture refrigerant in a receiver.

In the receiver 25, the liquid-phase non-azeotropic mixture refrigerant and the gas-phase non-azeotropic mixture refrigerant coexist in a separated manner. FIG. 2 is a gas-liquid equilibrium diagram illustrating the state of the non-azeotropic mixture refrigerant in the receiver 25.

In FIG. 2, the horizontal axis represents the ratio of a low-boiling refrigerant. The downwardly convex curve is a saturated liquid line representing the ratio of the low-boiling refrigerant with respect to the temperature under a constant pressure. The upwardly convex curve is a saturated vapor line representing the ratio of the low-boiling refrigerant with respect to the temperature under a constant pressure.

A subcooled state is below the saturated liquid line, a superheated state is above the saturated vapor line, and the region surrounded by the two curves is a gas-liquid two-phase state.

For example, when the temperature is To under a certain pressure Po, the ratio of the low-boiling refrigerant and the high-boiling refrigerant at a point b of the saturated vapor in the receiver 25 is 70% for the low-boiling refrigerant and 30% for the high-boiling refrigerant.

Furthermore, in this case, the ratio of the low-boiling refrigerant at a point c of the saturated liquid is 10%, and the ratio of the high-boiling refrigerant is 90%.

During the operation, the gas-liquid two-phase non-azeotropic mixture refrigerant enters the receiver 25, and therefore the liquid-phase non-azeotropic mixture refrigerant and the gas-phase non-azeotropic mixture refrigerant are separately accumulated in the receiver 25, and only the liquid-phase non-azeotropic mixture refrigerant flows out of the receiver 25.

Therefore, it is possible to estimate the composition ratio of the non-azeotropic mixture refrigerant circulating in the refrigerant circuit 10 by estimating the composition ratio of the liquid-phase non-azeotropic mixture refrigerant in the receiver 25.

(5) Controlling Composition Ratio of Non-azeotropic Mixture Refrigerant Circulating in Refrigerant Circuit 10

As may be seen from FIG. 2, the composition ratio of the liquid phase and the composition ratio of the gas phase have different ratios, and the ratio of the low-boiling refrigerant in the gas phase is larger than the ratio of the low-boiling refrigerant in the liquid phase. Conversely, the ratio of the high-boiling refrigerant in the liquid phase is larger than the ratio of the high-boiling refrigerant in the gas phase.

As the liquid-phase non-azeotropic mixture refrigerant flows out of the receiver 25 to the refrigerant circuit 10, the composition ratio of the non-azeotropic mixture refrigerant circulating in the refrigerant circuit 10 changes depending on how much liquid is accumulated in the receiver 25.

A method for controlling the composition ratio of the non-azeotropic mixture refrigerant circulating in the refrigerant circuit 10 will be described below by taking the cooling operation as an example.

Figure 3A:
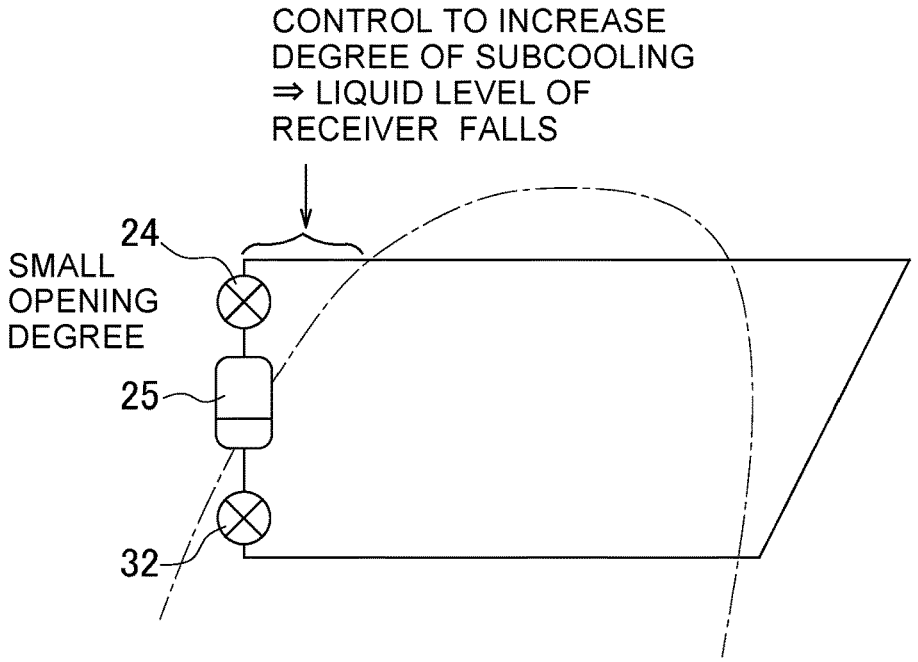
FIG. 3A is a cycle diagram illustrating the state where the opening degree of a first flow-rate adjustment valve is small and the degree of subcooling is large.
Figure 3B:
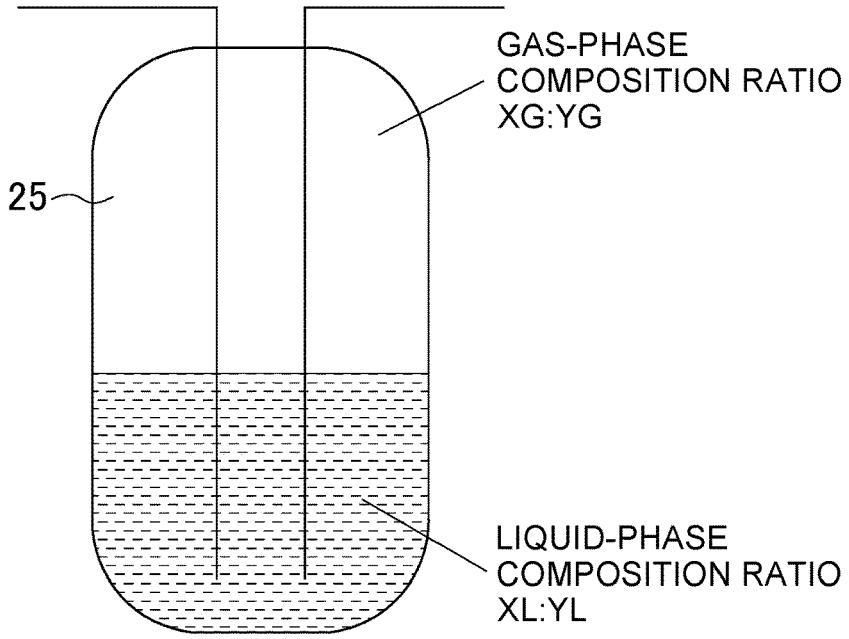
FIG. 3B is a cross-sectional view illustrating the liquid level of the non-azeotropic mixture refrigerant in the receiver when the opening degree of the first flow-rate adjustment valve is small and the degree of subcooling is large.

(5-1) Controlling Composition Ratio by Controlling Degree of Subcooling (5-1-1) Case of Large Degree of Subcooling FIG. 3A is a cycle diagram illustrating the state where the opening degree of the first flow-rate adjustment valve 24 is small and the degree of subcooling is large. FIG. 3B is a cross-sectional view illustrating the liquid level of the non-azeotropic mixture refrigerant in the receiver 25 when the opening degree of the first flow-rate adjustment valve is small and the degree of subcooling is large.

In FIGS. 3A and 3B, when the control unit 40 decreases the opening degree of the first flow-rate adjustment valve 24 to increase the degree of subcooling at the outlet of the outdoor heat exchanger 23, which is a condenser, the liquid level of the liquid-phase non-azeotropic mixture refrigerant in the receiver 25 becomes lower than before the degree of subcooling is changed.

Therefore, in the receiver 25, there is an increase in the volume of the gas-phase non-azeotropic mixture refrigerant, which is rich in the low-boiling refrigerant, and a decrease in the volume of the liquid-phase non-azeotropic mixture refrigerant, which is rich in the high-boiling refrigerant.

As illustrated in FIG. 3B, the gas-phase composition ratio is the low-boiling refrigerant:the high-boiling refrigerant=XG:YG, and the liquid-phase composition ratio is the low-boiling refrigerant:the high-boiling refrigerant=XL:YL. Furthermore, in the case of the gas phase, the ratio of the low-boiling refrigerant is large, and XG>XL. In the case of the liquid phase, the ratio of the high-boiling refrigerant is large, and YG<YL.

As a result, a large amount of the gas-phase non-azeotropic mixture refrigerant, which is rich in the low-boiling refrigerant, is collected in the receiver 25 from the refrigerant circuit than before the degree of subcooling is changed, and thus the composition of the non-azeotropic mixture refrigerant circulating in the refrigerant circuit 10 may be adjusted to the high-boiling side.

(5-1-2) Case of Small Degree of Subcooling

Figure 4A:
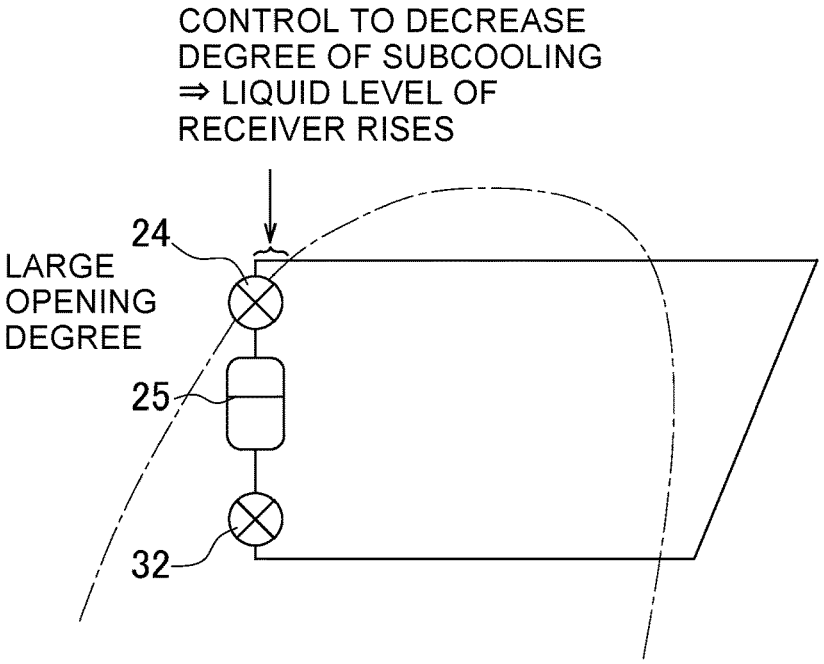
FIG. 4A is a cycle diagram illustrating the state where the opening degree of the first flow-rate adjustment valve is large and the degree of subcooling is small.
Figure 4B:
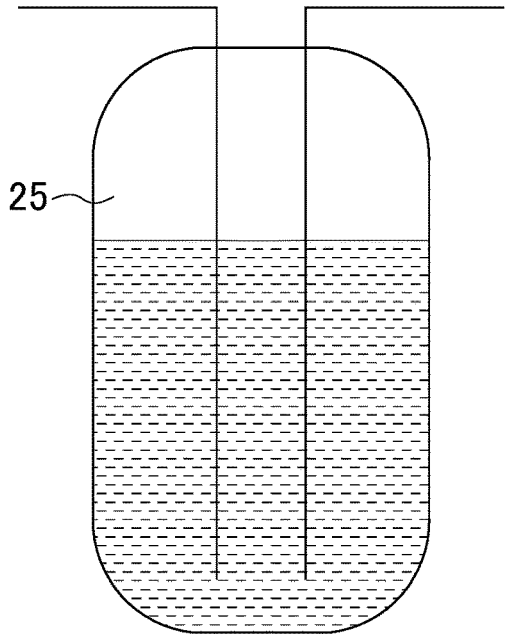
FIG. 4B is a cross-sectional view illustrating the liquid level of the non-azeotropic mixture refrigerant in the receiver when the opening degree of the first flow-rate adjustment valve is large and the degree of subcooling is small.

FIG. 4A is a cycle diagram illustrating the state where the opening degree of the first flow-rate adjustment valve 24 is large and the degree of subcooling is small. FIG. 4B is a cross-sectional view illustrating the liquid level of the non-azeotropic mixture refrigerant in the receiver 25 when the opening degree of the first flow-rate adjustment valve is large and the degree of subcooling is small.

In FIGS. 4A and 4B, when the control unit 40 increases the opening degree of the first flow-rate adjustment valve 24 to decrease the degree of subcooling at the outlet of the outdoor heat exchanger 23, which is a condenser, the liquid level of the liquid-phase non-azeotropic mixture refrigerant in the receiver 25 becomes higher.

Therefore, there is a decrease in the volume of the gas-phase non-azeotropic mixture refrigerant, which is rich in the low-boiling refrigerant, and an increase in the volume of the liquid-phase non-azeotropic mixture refrigerant, which is rich in the high-boiling refrigerant.

As a result, a large amount of the liquid-phase non-azeotropic mixture refrigerant, which is rich in the high-boiling refrigerant, is collected in the receiver 25 from the refrigerant circuit than before the degree of subcooling is changed, and thus the composition of the non-azeotropic mixture refrigerant circulating in the refrigerant circuit 10 may be adjusted to the low-boiling side.

Figure 5A:
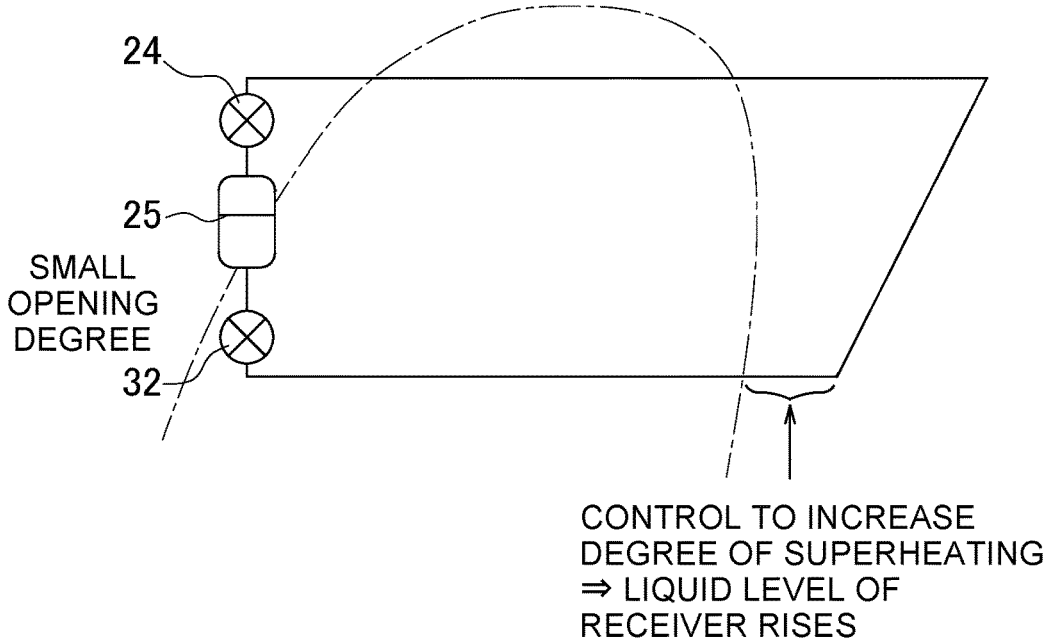
FIG. 5A is a cycle diagram illustrating the state where the opening degree of the second flow-rate adjustment valve is small and the degree of superheating is large.
Figure 5B:
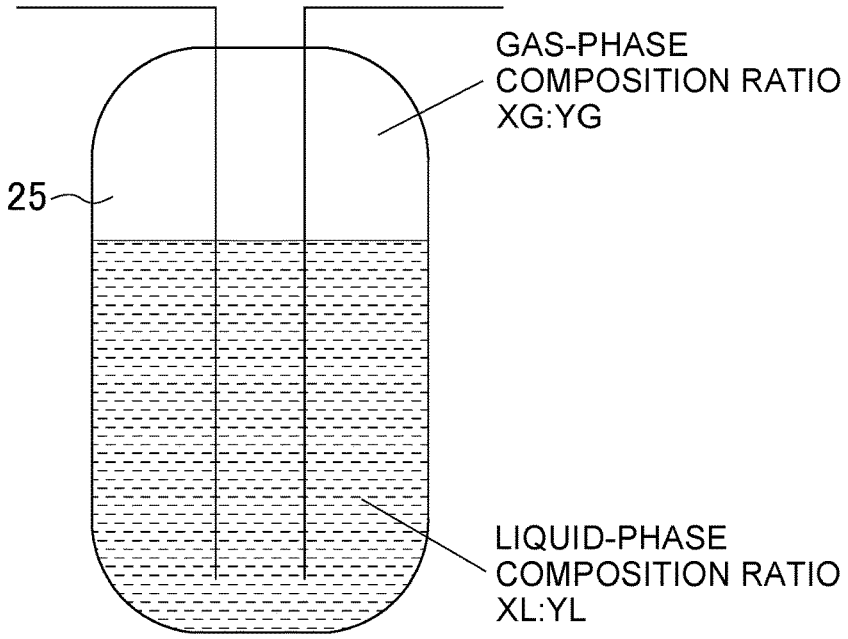
FIG. 5B is a cross-sectional view illustrating the liquid level of the non-azeotropic mixture refrigerant in the receiver when the opening degree of the second flow-rate adjustment valve is small and the degree of superheating is large.

(5-2) Controlling Composition Ratio by Controlling Degree of Superheating (5-2-1) Case of Large Degree of Superheating FIG. 5A is a cycle diagram illustrating the state where the opening degree of the second flow-rate adjustment valve 32 is small and the degree of superheating is large. FIG. 5B is a cross-sectional view illustrating the liquid level of the non-azeotropic mixture refrigerant in the receiver 25 when the opening degree of the second flow-rate adjustment valve 32 is small and the degree of superheating is large.

In FIGS. 5A and 5B, when the control unit 40 decreases the opening degree of the second flow-rate adjustment valve to increase the degree of superheating at the outlet of the indoor heat exchanger 33, which is an evaporator, the liquid level of the liquid-phase non-azeotropic mixture refrigerant in the receiver 25 becomes higher.

Therefore, there is a decrease in the volume of the gas-phase non-azeotropic mixture refrigerant, which is rich in the low-boiling refrigerant, and an increase in the volume of the liquid-phase non-azeotropic mixture refrigerant, which is rich in the high-boiling refrigerant. In this case, as illustrated in FIG. 5B, the gas-phase composition ratio is the low-boiling refrigerant:the high-boiling refrigerant=XG:YG, and the liquid-phase composition ratio is the low-boiling refrigerant:the high-boiling refrigerant=XL:YL. Furthermore, in the case of the gas phase, the ratio of the low-boiling refrigerant is large, and XG>XL. In the case of the liquid phase, the ratio of the high-boiling refrigerant is large, and YG<YL.

As a result, a large amount of the liquid-phase non-azeotropic mixture refrigerant, which is rich in the high-boiling refrigerant, is collected in the receiver 25 from the refrigerant circuit than before the degree of superheating is changed, and thus the composition of the non-azeotropic mixture refrigerant circulating in the refrigerant circuit 10 may be adjusted to the low-boiling side.

(5-2-2) Case of Small Degree of Superheating

Figure 6A:
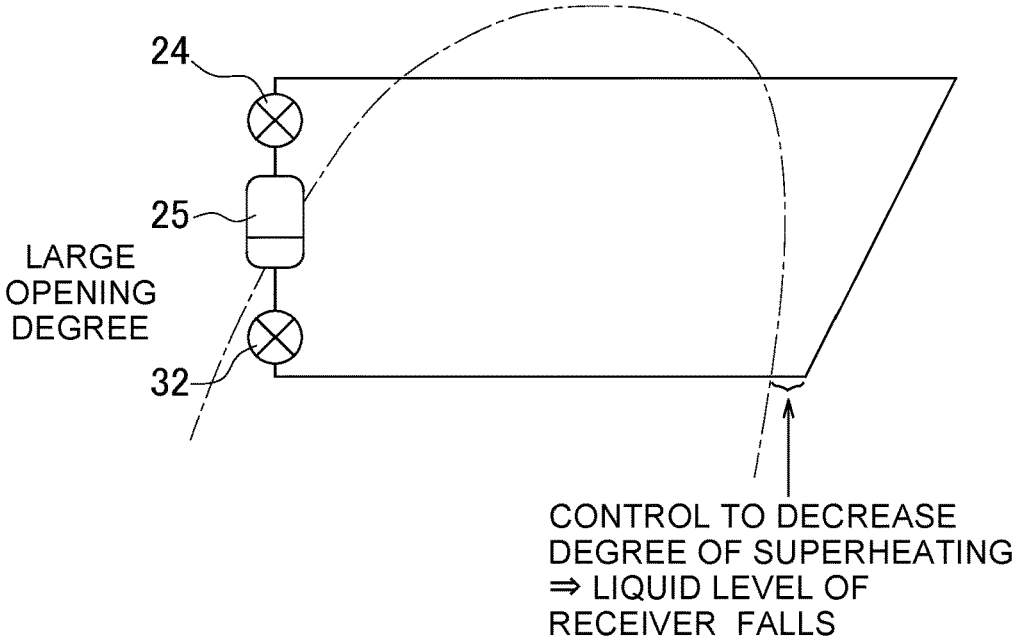
FIG. 6A is a cycle diagram illustrating the state where the opening degree of the second flow-rate adjustment valve is large and the degree of superheating is small.
Figure 6B:
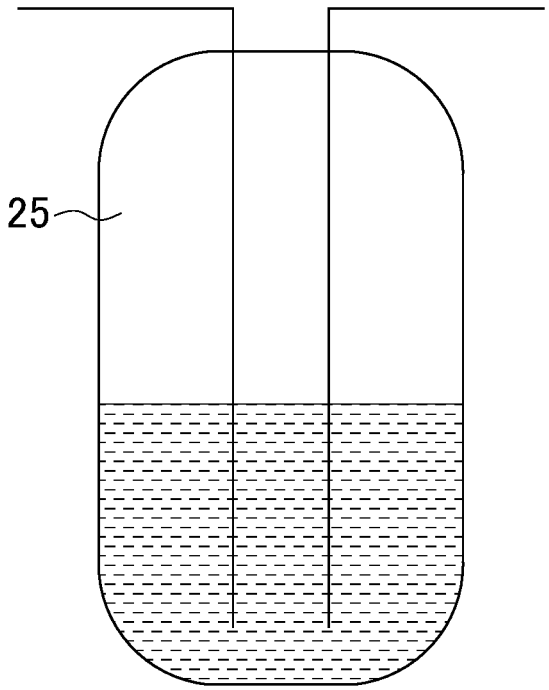
FIG. 6B is a cross-sectional view illustrating the liquid level of the non-azeotropic mixture refrigerant in the receiver when the opening degree of the second flow-rate adjustment valve is large and the degree of superheating is small.

FIG. 6A is a cycle diagram illustrating the state where the opening degree of the second flow-rate adjustment valve 32 is large and the degree of superheating is small. FIG. 6B is a cross-sectional view illustrating the liquid level of the non-azeotropic mixture refrigerant in the receiver 25 when the opening degree of the second flow-rate adjustment valve 32 is large and the degree of superheating is small.

In FIGS. 6A and 6B, when the control unit 40 increases the opening degree of the second flow-rate adjustment valve 32 to decrease the degree of superheating at the outlet of the indoor heat exchanger 33, which is an evaporator, the liquid level of the liquid-phase non-azeotropic mixture refrigerant in the receiver 25 becomes lower.

Therefore, in the receiver 25, there is an increase in the volume of the gas-phase non-azeotropic mixture refrigerant, which is rich in the low-boiling refrigerant, and a decrease in the volume of the liquid-phase non-azeotropic mixture refrigerant, which is rich in the high-boiling refrigerant.

As a result, a large amount of the gas-phase non-azeotropic mixture refrigerant, which is rich in the low-boiling refrigerant, is collected from the refrigerant circuit 10, than before the degree of superheating is changed, and the composition of the non-azeotropic mixture refrigerant circulating in the refrigerant circuit 10 may be adjusted to the high-boiling side.

(6) Feature (6-1)

In the air conditioner 100, during the operation, the gas-liquid two-phase non-azeotropic mixture refrigerant enters the receiver 25 and accumulates in the receiver in a state where the gas phase and the liquid phase are separated. For example, when the non-azeotropic mixture refrigerant includes two components, i.e., a high-boiling refrigerant and a low-boiling refrigerant, the control unit 40 may estimate the ratio (composition ratio) between the low-boiling refrigerant and the high-boiling refrigerant in each of the gas phase and the liquid phase based on the temperature and the pressure of the non-azeotropic mixture refrigerant in the receiver 25. Therefore, the control unit 40 may estimate the composition ratio of the liquid-phase non-azeotropic mixture refrigerant flowing out of the receiver 25 as the composition ratio of the non-azeotropic mixture refrigerant circulating in the refrigerant circuit 10.

(6-2)

In the air conditioner 100, the composition ratio of the non-azeotropic mixture refrigerant circulating in the refrigerant circuit 10 changes depending on how much liquid-phase non-azeotropic mixture refrigerant is accumulated in the receiver 25. In the gas phase, the refrigerant includes a large amount of low-boiling refrigerant and is rich in the low-boiling refrigerant. Conversely, in the liquid phase, the refrigerant is rich in the high-boiling refrigerant. The control unit 40 reduces the volume of the gas-phase non-azeotropic mixture refrigerant in the receiver 25 so as to perform control such that the non-azeotropic mixture refrigerant circulating in the refrigerant circuit 10 includes a large amount of low-boiling refrigerant than before the reduction.

(6-3)

In the air conditioner 100, when the control unit 40 increases the opening degree of the first flow-rate adjustment valve 24 on the upstream side of the receiver 25, the degree of subcooling at the outlet of the outdoor heat exchanger 23, which is a condenser, decreases, and the liquid-phase non-azeotropic mixture refrigerant accumulated in the receiver 25 increases. Conversely, when the control unit 40 decreases the opening degree of the first flow-rate adjustment valve 24, the degree of subcooling at the outlet of the outdoor heat exchanger 23, which is a condenser, increases, the liquid-phase non-azeotropic mixture refrigerant in the receiver 25 decreases, and the gas-phase non-azeotropic mixture refrigerant increases. As described above, the control unit 40 adjusts the degree of subcooling of the non-azeotropic mixture refrigerant at the outlet of the outdoor heat exchanger 23 and thus may adjust the ratio between the gas-phase and liquid-phase non-azeotropic mixture refrigerants accumulated in the receiver 25.

(6-4)

In the air conditioner 100, when the control unit 40 decreases the opening degree of the second flow-rate adjustment valve 32 on the downstream side of the receiver 25, the degree of superheating at the outlet of the indoor heat exchanger 33, which is an evaporator, increases, and the liquid-phase non-azeotropic mixture refrigerant accumulated in the receiver 25 increases. Conversely, when the control unit 40 increases the opening degree of the second flow-rate adjustment valve 32, the degree of superheating decreases, the liquid-phase non-azeotropic mixture refrigerant in the receiver 25 decreases, and the gas-phase non-azeotropic mixture refrigerant increases. As described above, the control unit 40 adjusts the degree of superheating of the non-azeotropic mixture refrigerant at the outlet of the indoor heat exchanger 33 and thus may adjust the ratio between the gas-phase and liquid-phase non-azeotropic mixture refrigerants accumulated in the receiver 25.

(7) Others (7-1) Estimation of Flammability and Toxicity

In the air conditioner 100, as the control unit 40 may estimate the composition ratio of the non-azeotropic mixture refrigerant circulating in the refrigerant circuit 10, physical property values regarding flammability and toxicity may be estimated based on the composition ratio.

Here, the physical property values regarding flammability are a flammability lower limit, a flammability upper limit, a flammability velocity, and a flammability energy. Furthermore, the physical property value regarding toxicity is an exposure concentration limit.

These physical property values are different for each of the components constituting the non-azeotropic mixture refrigerant, and therefore the physical property values regarding flammability and toxicity also change when the composition ratio changes.

Furthermore, for example, after evaluating the above-described physical property value regarding the flammability for each composition ratio, the classification of the flammability belonging to each composition ratio may be previously stored in accordance with the U.S. ASHRAE34 standard based on the evaluation result. Further, the above-described physical property value regarding toxicity may be evaluated, and the classification of "toxicity" or "non-toxicity" may be stored for each composition ratio based on the evaluation result.

Furthermore, the classes indicating the classifications of both flammability and toxicity are generated, and the corresponding classes ("non-flammability, non-toxicity", "non-flammability, toxicity", "slight flammability, non-toxicity", "slight flammability, toxicity", "strong flammability, non-toxicity", and "strong flammability, toxicity") are stored, and thus the classes of flammability and toxicity may be estimated based on the estimated composition ratio.

(7-2) Estimation of Occurrence or Non-Occurrence of Disproportionation Reaction

A disproportionation reaction occurs under a high-temperature and high-pressure condition. Furthermore, as the disproportionation reaction also depends on the concentration, the disproportionation reaction is likely to occur when the composition ratio of a specific refrigerant increases.

In the air conditioner 100, the control unit 40 may estimate the composition ratio of the non-azeotropic mixture refrigerant circulating in the refrigerant circuit 10, and therefore it is determined whether the composition ratio is a ratio at which the disproportionation reaction is likely to occur, and thus it is possible to estimate whether the disproportionation reaction is likely to occur in the circulating non-azeotropic mixture refrigerant.

For example, when the estimated composition ratio of the non-azeotropic mixture refrigerant is a composition ratio out of an allowable range of the composition ratio of components that cause a disproportionation reaction, it may be determined that there is a possibility of causing a disproportionation reaction, a warning may be issued, and the operation of the air conditioner may be stopped.

On the other hand, when the estimated composition ratio of the non-azeotropic mixture refrigerant is a composition ratio within the allowable range of the composition ratio of the components that cause the disproportionation reaction, it may be determined that there is no possibility of causing the disproportionation reaction, and the operation of the air conditioner may be continued.

(7-3) Component of Non-Azeotropic Mixture Refrigerant

According to the above-described embodiment, CO2 and R1234yf have been described as examples of the components of the non-azeotropic mixture refrigerant; however, that is not a limitation, and for example, CO2 and R1234ze may be included as components. Furthermore, instead of the above-described CO2, R1132(E) or R1123 may be included.

For example, in terms of the relationship with the disproportionation reaction described above, R1132(E) or R1123 is a refrigerant having a high level of disproportionation reaction. Further, the disproportionation reaction also depends on the concentration, and when the composition ratio of R1132(E) or R1123 is increased, the disproportionation reaction is likely to occur, and therefore the estimation of the composition ratio is important.

Although the embodiment of the present disclosure has been described above, it is understood that various modifications may be made to forms and details without departing from the spirit and scope of the present disclosure described in the scope of claims.

INDUSTRIAL APPLICABILITY

According to the above embodiment, the air conditioner installed in a building has been described as an example, but this is not a limitation, and also applications may be made to in-vehicle air conditioners.

EXPLANATION OF REFERENCE

10 Refrigerant circuit
21 Compressor
22 Four-way switching valve
23 Outdoor heat exchanger (condenser, evaporator)
24 First flow-rate adjustment valve (first expansion mechanism)
25 Receiver (container)
26 Temperature sensor (temperature measurement unit)
30 Pressure sensor (pressure measurement unit)
32 Second flow-rate adjustment valve (second expansion mechanism)
33 Indoor heat exchanger (evaporator, condenser)
40 Control unit
41 Outdoor-side control unit (control unit)
42 Indoor-side control unit (control unit)
100 Air conditioner (heat pump device)

CITATION LIST

Patent Literature

PTL 1: Japanese Patent No. 3463710

The invention claimed is:

1. A heat pump device having a non-azeotropic mixture refrigerant circulating in a refrigerant circuit in which a compressor, a four-way switching valve, a heat source side heat exchanger, a first flow-rate adjustment valve, a second flow-rate adjustment valve, and a use side heat exchanger are sequentially coupled with pipes in a circular pattern, the heat pump device comprising:

a container coupled between the first flow-rate adjustment valve and the second flow-rate adjustment valve;

a temperature sensor that measures a temperature of the non-azeotropic mixture refrigerant in the container;

a pressure sensor that measures a pressure of the non-azeotropic mixture refrigerant in the container; and a controller that estimates a physical property of the circulating non-azeotropic mixture refrigerant based on the temperature and the pressure of the non-azeotropic mixture refrigerant accumulated in the container, wherein the controller controls the first flow-rate adjustment valve to adjust a degree of subcooling of the non-azeotropic mixture refrigerant at an outlet of the heat source side heat exchanger and thus adjusts a ratio of gas-phase and liquid-phase non-azeotropic mixture refrigerants accumulated in the container.

2. The heat pump device according to claim 1, wherein the controller estimates a composition ratio of the circulating non-azeotropic mixture refrigerant based on the temperature and the pressure of the non-azeotropic mixture refrigerant accumulated in the container.

3. The heat pump device according to claim 1, wherein the controller estimates a physical property value regarding flammability or toxicity of the circulating non-azeotropic mixture refrigerant based on the temperature and the pressure of the non-azeotropic mixture refrigerant accumulated in the container.

4. The heat pump device according to claim 1, wherein the controller estimates whether a disproportionation reaction is likely to occur in the circulating non-azeotropic mixture refrigerant based on the temperature and the pressure of the non-azeotropic mixture refrigerant accumulated in the container.

5. The heat pump device according to claim 1, wherein the controller controls the first flow-rate adjustment valve or the second flow-rate adjustment valve or the first flow-rate adjustment valve and the second flow-rate adjustment valve to adjust a ratio of gas-phase and liquid-phase non-azeotropic mixture refrigerants accumulated in the container.

6. The heat pump device according to claim 1, wherein the controller controls the second flow-rate adjustment valve to adjust a degree of superheating of the non-azeotropic mixture refrigerant at an outlet of the user-side heat exchanger and thus adjusts a ratio of gas-phase and liquid-phase non-azeotropic mixture refrigerants accumulated in the container.

7. The heat pump device according to claim 1, wherein the non-azeotropic mixture refrigerant includes CO2 and R1234yf or R1234ze as components.

8. The heat pump device according to claim 1, wherein the non-azeotropic mixture refrigerant includes R1132(E) or R1123 as a component.

9. The heat pump device according to claim 2, wherein the controller estimates a physical property value regarding flammability or toxicity of the circulating non-azeotropic mixture refrigerant based on the temperature and the pressure of the non-azeotropic mixture refrigerant accumulated in the container.

10. The heat pump device according to claim 2, wherein the controller controls the first flow-rate adjustment valve or the second flow-rate adjustment valve or the first flow-rate adjustment valve and the second flow-rate adjustment valve to adjust a ratio of gas-phase and liquid-phase non-azeotropic mixture refrigerants accumulated in the container.

11. The heat pump device according to claim 3, wherein the controller controls the first flow-rate adjustment valve or the second flow-rate adjustment valve or the first flow-rate adjustment valve and the second flow-rate adjustment valve to adjust a ratio of gas-phase and liquid-phase non-azeotropic mixture refrigerants accumulated in the container.

12. The heat pump device according to claim 4, wherein the controller controls the first flow-rate adjustment valve or the second flow-rate adjustment valve or the first flow-rate adjustment valve and the second flow-rate adjustment valve to adjust a ratio of gas-phase and liquid-phase non-azeotropic mixture refrigerants accumulated in the container.

13. The heat pump device according to claim 2, wherein the controller controls the second flow-rate adjustment valve to adjust a degree of superheating of the non-azeotropic mixture refrigerant at an outlet of the evaporator user-side heat exchanger and thus adjusts a ratio of gas-phase and liquid-phase non-azeotropic mixture refrigerants accumulated in the container.

14. The heat pump device according to claim 3, wherein the controller controls the second flow-rate adjustment valve to adjust a degree of superheating of the non-azeotropic mixture refrigerant at an outlet of the evaporator user-side heat exchanger and thus adjusts a ratio of gas-phase and liquid-phase non-azeotropic mixture refrigerants accumulated in the container.

15. The heat pump device according to claim 4, wherein the controller controls the second flow-rate adjustment valve to adjust a degree of superheating of the non-azeotropic mixture refrigerant at an outlet of the user-side heat exchanger and thus adjusts a ratio of gas-phase and liquid-phase non-azeotropic mixture refrigerants accumulated in the container.

16. The heat pump device according to claim 2, wherein the non-azeotropic mixture refrigerant includes CO2 and R1234yf or R1234ze as components.

17. The heat pump device according to claim 3, wherein the non-azeotropic mixture refrigerant includes CO2 and R1234yf or R1234ze as components.

18. The heat pump device according to claim 4, wherein the non-azeotropic mixture refrigerant includes CO2 and R1234yf or R1234ze as components.

19. The heat pump device according to claim 5, wherein the non-azeotropic mixture refrigerant includes CO2 and R1234yf or R1234ze as components.

20. The heat pump device according to claim 6, wherein the non-azeotropic mixture refrigerant includes CO2 and R1234yf or R1234ze as components.

* * * * *